US008870296B2

(12) United States Patent
Lahidalga

(10) Patent No.: US 8,870,296 B2
(45) Date of Patent: Oct. 28, 2014

(54) HYDRAULIC RIPPER FOR EXCAVATORS

(76) Inventor: Javier Aracama Martinez De Lahidalga, Vitoria-Gasteiz (ES)

( * ) Notice: Subject to any disclaimer, the term of this patent is extended or adjusted under 35 U.S.C. 154(b) by 15 days.

(21) Appl. No.: 13/384,162

(22) PCT Filed: Feb. 15, 2010

(86) PCT No.: PCT/ES2010/070080

§ 371 (c)(1),
(2), (4) Date: Mar. 30, 2012

(87) PCT Pub. No.: WO2011/007030

PCT Pub. Date: Jan. 20, 2011

(65) Prior Publication Data

US 2012/0187744 A1 Jul. 26, 2012

(30) Foreign Application Priority Data

Jul. 16, 2009 (ES) ..... 200930465

(51) Int. Cl.
*E02F 5/32* (2006.01)
*E01C 23/12* (2006.01)

(52) U.S. Cl.
CPC ..... *E02F 5/323* (2013.01); *E02F 5/326* (2013.01); *E01C 23/122* (2013.01)
USPC ..... 299/37.2; 299/37.3

(58) Field of Classification Search
CPC ..... E02F 5/326; E02F 5/103; E01C 23/124; E01C 23/0855; B25D 17/245
USPC ..... 299/37.1, 37.2, 37.3
See application file for complete search history.

(56) References Cited

U.S. PATENT DOCUMENTS

| | | | | |
|---|---|---|---|---|
| 3,539,018 | A | 11/1970 | Sprenkel | |
| 3,682,254 | A * | 8/1972 | Hoeffleur | 173/49 |
| 4,168,751 | A * | 9/1979 | Deike | 173/1 |
| 4,258,956 | A * | 3/1981 | Gurries | 299/14 |
| 4,679,635 | A * | 7/1987 | Fields | 172/260.5 |
| 2005/0189125 | A1 | 9/2005 | Matsumoto et al. | |
| 2006/0214041 | A1 * | 9/2006 | Yao et al. | 241/175 |
| 2011/0308117 | A1 * | 12/2011 | Park | 37/447 |
| 2013/0092405 | A1 * | 4/2013 | Hall | 172/1 |

FOREIGN PATENT DOCUMENTS

| | | | |
|---|---|---|---|
| SU | 1208150 | A1 | 1/1986 |
| WO | WO 87/04893 | A1 | 8/1987 |
| WO | WO 2009/022762 | A1 | 2/2009 |

* cited by examiner

*Primary Examiner* — David Bagnell
*Assistant Examiner* — Michael Goodwin
(74) *Attorney, Agent, or Firm* — Arent Fox LLP

(57) ABSTRACT

Hydraulic hammer ripper for mechanical diggers of the type used to break and pry up hard features in the ground, such as stone, concrete, asphalt or such like and which comprises a tooth (1) attached to the headstock (5) on the mechanical digger by means of an array of attachment items (6) and which consists of, at least, a tooth (1), with its drive devices (2, 3) solidly attached to a power accumulator (4) whereby the assembly formed by the tooth (1), drive devices (2, 3) and power accumulator (4) is solidly attached to said tooth (1) and mounted on the longitudinal axis (7) of the tooth (1) whereby it is by means of said axis (7) that the striking of the ground is effected by means of the tooth (1) positions of withdrawn (A) and deployed (B).

15 Claims, 7 Drawing Sheets

HYDRAULIC RIPPER FOR EXCAVATORS

CROSS-REFERENCE TO RELATED APPLICATION

This Application is a National Stage entry of International Application No. PCT/ES2010/070080, having an international filing date of Feb. 15, 2010; which claims priority to Spanish Application No.: P 200930465, filed Jul. 16, 2009, the disclosure of each of which is hereby incorporated in its entirety by reference.

The purpose of this invention is a hydraulic hammer ripper as an accessory for a mechanical digger that breaks and pries up stone, concrete, asphalt, etc., and which basically consists of a hydraulic motor that receives pressure and an oil flow from the mechanical digger and which drives a series of devices that operate a tooth, providing it with the necessary movement to strike the ground.

BACKGROUND OF THE INVENTION

At present, rippers for mechanical diggers basically consist of an array of teeth solidly joined together and driven directly from the mechanical digger by hydraulic means, as stated in US patent US2005189125 by KOMATSU, wherein the variations in operation and the best rendering of said operation lie in the design of the actual tooth and the combination of the force of the various cylinders for improving the strike on the ground.

Nevertheless, said systems lack the means to render the best strike on the ground, directly in each one of the teeth, through the percussion of each tooth with an independent mechanism that provides a hammer action on the ground through the actual tooth.

Document WO2009/022762 describes a vibration system for a tooth in which transmission is made to said tooth of the vibration frequency, but in which the inertia of the tooth is not used to make a strike on the ground. This means that said vibration system does not ensure a high performance given that the application of the vibration means that the tooth does not hit the ground, wasting the energy generated. In addition, the connection between the headstock and the tooth-vibrator assembly involves a passive damper of the silent-block type that although it absorbs the shock on the digger it does not allow re-using the energy from the vibrations for striking the ground.

DESCRIPTION OF THE INVENTION

In order to solve the technical problem for rendering the best strike on the ground by a ripper, presentation is made of the hydraulic hammer ripper for mechanical diggers, the object of this invention, in which said ripper is of the type used to break and pry up hard features in the ground, such as stone, concrete, asphalt or such like. It comprises a tooth attached to the headstock on the mechanical digger by means of an array of attachment items, and which basically consists of a tooth, with drive devices solidly attached to a power accumulator in which the assembly formed by the tooth, the drive devices and the power accumulator is solidly attached to said tooth and mounted on the longitudinal axis of the tooth that strikes the ground, by means of the tooth positions of withdrawn and deployed.

The main advantage of this invention as regards the state-of-the-art is that on rippers currently in use, the force of the ripper is that provided by the mechanical digger upon which it is mounted, through its pull, as it simply embeds and pulls, whereas in this invention the strength of the ripper is provided by the sum of the percussion forces on the actual ripper with the involvement of the power accumulator, as the summation of forces on the longitudinal axis of the tooth that strikes the ground, embedding itself in the ground, plus the pull of the machine dragging the ground.

BRIEF DESCRIPTION OF THE DRAWINGS

There follows a very brief description of a series of drawings that help to provide a better understanding of the invention and which are associated expressly with an embodiment of said invention that is presented as a non-limiting example thereof.

DETAILED DESCRIPTION OF A PREFERRED EMBODIMENT

Figure 1:
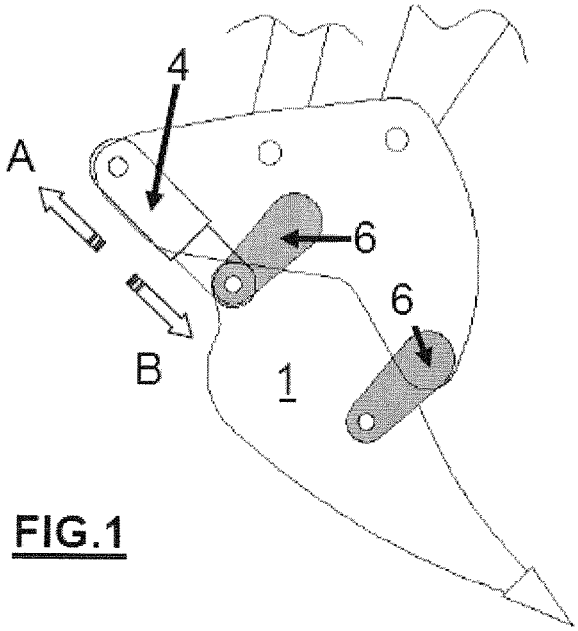
FIG. 1 is a schematic view of the hydraulic hammer ripper for mechanical diggers in accordance with the present invention, showing the internal operating arrangement in detail.

As can be seen in the attached drawings, the hydraulic hammer ripper for mechanical diggers of the type used for breaking and prying up hard features in the ground, such as stone, concrete, asphalt or such like comprises, at least, a tooth (1), with a series of drive devices (2, 3) consisting of two cams solidly attached to a power accumulator (4), preferably an air-cushion or pneumatic cylinder and, in general, whatsoever device that allows the accumulation of energy whereby when the tooth (1) is being raised said accumulator (4) is charged (compressed in the case of a pneumatic cylinder or air-cushion), whereas when it is being dropped, said accumulator (4) discharges (decompresses in the case of a pneumatic cylinder or air-cushion), wherein the assembly formed by the tooth (1) and the drive devices (2, 3) and the power accumulator (4) is attached to the headstock (5) on the mechanical digger by means of a series of connections (6), preferably anchor rods.

The drive devices (2, 3) are connected to a hydraulic motor that receives pressure and an oil flow from the actual mechanical digger, which ensures that the first cam (2) and the second cam (3) that make up the aforementioned drive devices turn in opposite directions to each other.

Figure 2:
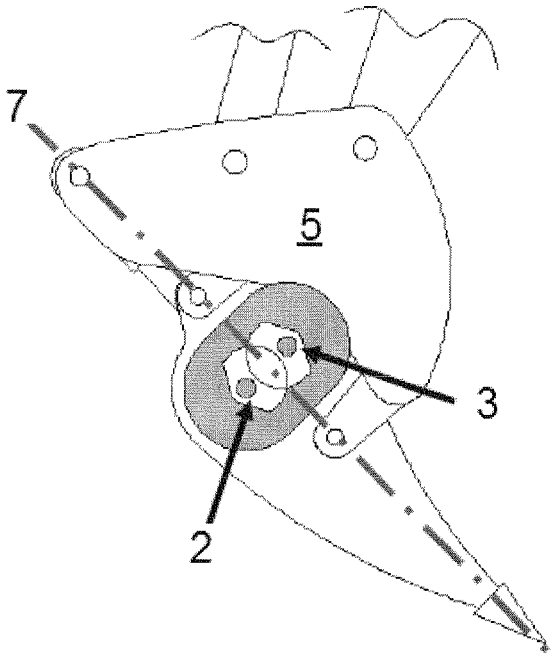
FIG. 2 is a schematic view of the hydraulic hammer ripper for mechanical diggers in accordance with the present invention, showing the operating axis on the tooth in detail.

Vector axis (7) is the name given to the force vector generated by the drive devices (2, 3) when they rotate. There are different options for the position of these drive devices regarding said vector axis (7). A first option is that the position of the first cam (2) and of the second cam (3) is symmetrical regarding the vector axis (7) of the tooth (1) defined by the line that runs from the apex of the tip on the tooth (1) and passes through the rotation points on said tooth (1). This symmetry is produced because the shaft on each cam (2, 3) is engaged with the shaft on the other cam. This engagement means that the first cam (2) and the second cam (3) turn in opposite directions and do not lose their respective angular positions. In other words, the vector axis (7) is perpendicular to the plane occupied by the rotation shafts on the drive devices (2, 3). Accordingly, the end of the tooth (1) describes a line of strike according to the actual axis, as observed in FIGS. 2 and 3.

Figure 3:
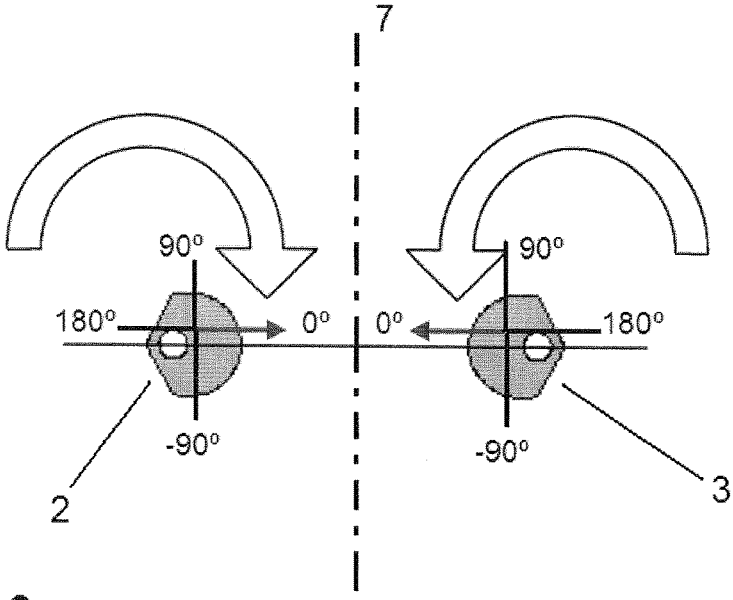
FIG. 3 is a diagram of the forces on the drive devices of the hydraulic hammer ripper for mechanical diggers, in accordance with the present invention.

Therefore, and referring to the angular positions of the cams (2, 3), when these cams (2, 3) are in an angular position 0° (defined within the reference arrangement formed by the axis (7) of the tooth (1) as the y-axis of coordinates and that defined by the cams (2, 3) as the x-axis, as observed in FIG. 3), the centrifugal force generated by the first cam (2) cancels out the centrifugal force of the second cam, given that both cams (2, 3) have the same mass and centre of gravity (located on the axis (7) of the tooth (1)). This same effect is achieved when the angle between cams (2, 3) is 180°.

Nevertheless, with an angular position of −90°, the centrifugal forces are combined in the downward direction (A), and given the attachment with the tooth (1), they pull on it, generating the greater downward force vector on the axis (7) of the tooth (1), impacting on the ground. The opposite effect occurs with an angular position of 90° between cams (2, 3) given that the forces are combined in an upward direction (B), pulling on the tooth (1) which is solidly attached to the power accumulator (4), compressing it and increasing its internal pressure. This is when the tooth (1) is withdrawn from the ground.

Figure 4:
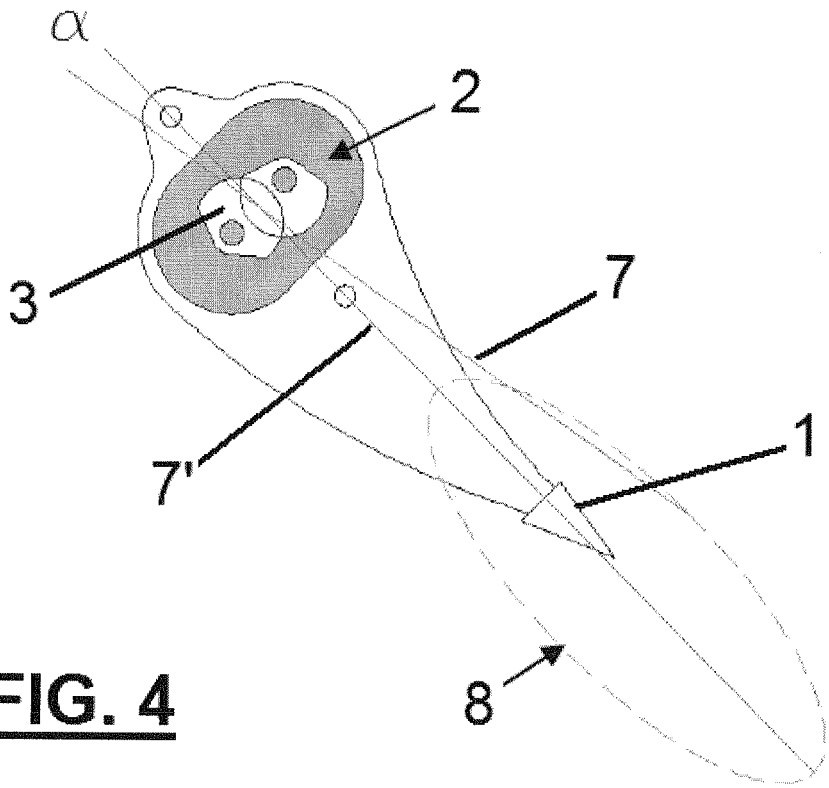
FIG. 4 is a schematic view of the hydraulic hammer ripper for mechanical diggers, in accordance with the present invention, showing the change of angle between the drive devices.
Figure 5:
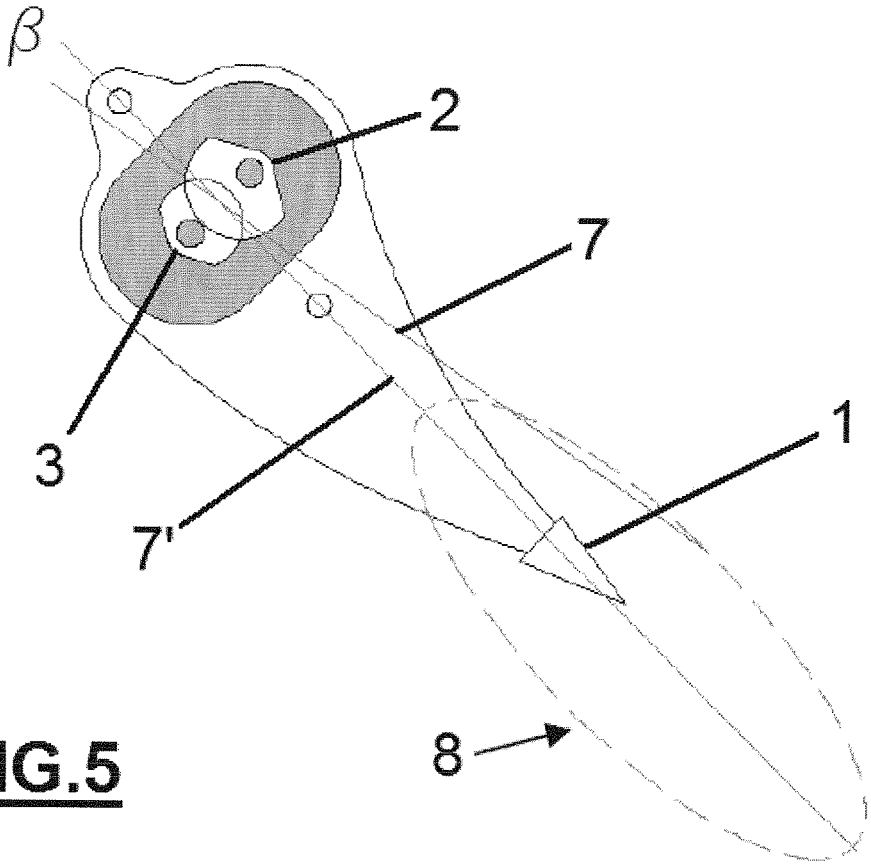
FIG. 5 is a schematic view of the hydraulic hammer ripper for mechanical diggers, in accordance with the present invention, showing the change in the centre of gravity of the drive devices.

The energy stored in the accumulator (4) will be released when the cams (2, 3) move from the angular position of +90° to the angular position of −90°; that is, when the tooth (1) moves down onto the ground, thereby improving the impact made by the tooth (1). Nevertheless, it is also possible that the end of the vector axis (7) does not describe a straight line of strike, as noted in the previous case, but rather in another embodiment, the end of the tooth (1) describes an ellipse (8) whose greater axis is precisely the guide axis (7'), instead of the straight line mentioned previously. This produces a pivoting movement that makes it easier to break the ground. This is possible thanks to a certain angle ($\alpha$,$\beta$) generated between the vector axis (7) and the guide axis (7'). These angles are achieved by taking into account the following options:

(a) Change in the angle of the drive devices (2, 3) between each other, as shown in FIG. 4; or (b) Change in the centre of gravity of, at least, one of the drive devices (2, 3), as shown in FIG. 5.

In the first of these options, the change of angle may be constant; that is, once it has been adjusted, the ellipse (8) described by the end of the tooth (1) is always the same, or else variable, which means that the variation in the angle is made according to the decision of the operator, with the digger in operation, or being changed automatically according to the revolutions, angle of strike, ground resistance, or any other variable that implies an added advantage by increasing the ellipse described. This change in angle means that there is a certain angle ($\alpha$) between the vector axis (7) and the guide axis (7'), being the one that permits the elliptical movement of the end of the tooth (1).

In the second of these options, the ellipse (8) described by the end of the tooth (1) can be achieved by changing the centre of gravity between the drive devices (2, 3); that is, said drive devices (2, 3) are not symmetrical, generating a guide axis (7') with a certain angle ($\beta$) between this guide axis (7') and the vector axis (7). This change may be effected by increasing the mass or the diameter of one of the drive devices (2, 3).

Figure 6:
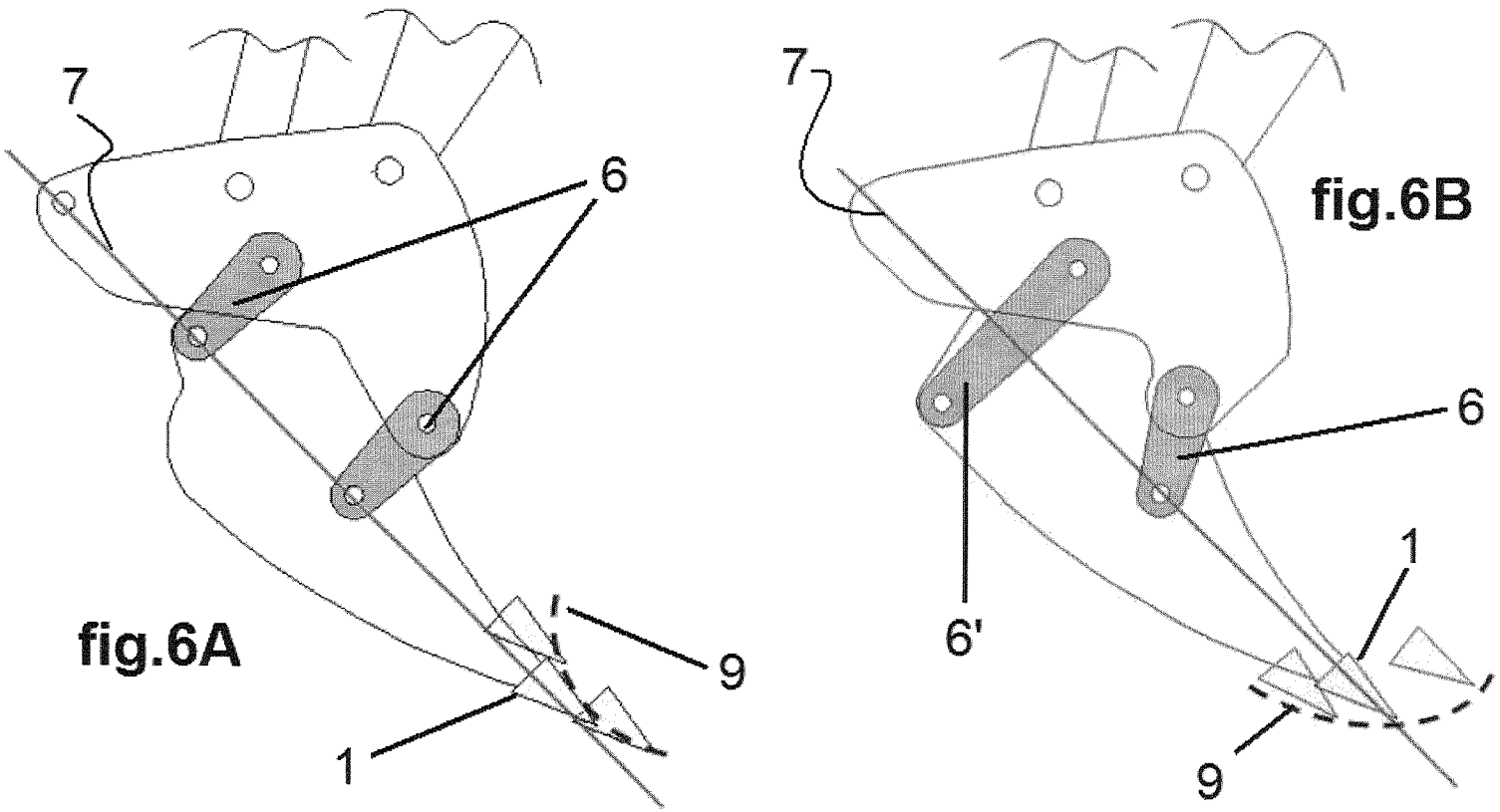
FIG. 6 is a schematic view of the hydraulic hammer for ripper mechanical diggers, in accordance with the present invention, showing the guide system involving connecting rods, using two identical rods (FIG. 6A) or two different rods (FIG. 6B).

As noted, the connection between the tooth (1) and the digger is made via the headstock (5), which is attached to the digger by means of bolts or an automatic coupling, if the mechanical digger is fitted with this option. The connection is to be as rigid as possible, except on the axis itself (7) of the tooth (1) which is to pivot to strike the ground or charge the power accumulator (4). This rigidity is important because the digger is going to generate nail-type pull forces. The attachment between the headstock (5) and the tooth (1) is made using anchoring rods (6) which allow pivoting between headstock (5) and tooth (1). The anchoring rods (6) may be mounted in different arrangements in terms of lengths, angles and/or initial position, whereby the trajectory (9) described by the end of the tooth (1) is different to the trajectory of the vector axis (7), as can be seen in FIG. 6, wherein it can be seen that by changing the length and anchoring point of one of the rods (6'), as can be seen in FIG. 6B, the trajectory (9) of the tooth (1) does not follow the same direction as the vector axis (7), as in the option in FIG. 6A (identical rods), but instead this trajectory is such that it helps to break the ground, as the result of the difference in the anchoring rods (6) is a greater pivoting movement. When the tooth (1) falls as in FIG. 6B, the tooth (1) always "crabs" towards the digger itself, thereby helping to break the ground, contrary to what happens in FIG. 6A, where in around the upper half of the run the tooth (1) moves away from the digger.

These anchoring rods (6) may be replaced by other connection devices, such as, for example, linear guides, which provide an attachment between the headstock (5) and tooth (1) like the one described.

Finally, it should be noted that, in another particular embodiment of the invention, depending on the resistance offered by the different types of ground, it is convenient to be able to vary the impact energy of the tooth (1) by acting upon the power accumulator (4); that is, varying its rigidity and/or position.

(A) Variation in rigidity: It is possible to increase or reduce the gas pressure in the internal chamber of the power accumulator (4) and/or vary the internal volume of the power accumulator (4) manually or automatically, for example, by means of a system that reduces the internal volume of the air-cushion at the decision of the operator or by reducing the internal volume of the pneumatic cylinder. It should be remembered that the more rigid the accumulator is, the less freedom of movement there will be, although it will be faster.

(B) Variation in position: The position of the power accumulator (4) can be changed whereby the power transmission between the tooth (1) and the power accumulator (4) is not direct, aligned and linear, altering the impact energy. Likewise, the angle between the accumulator (4) and the tooth can be changed or they can be made to interact by means of a system of levers.

PRACTICAL EXAMPLE OF THE USE OF THE INVENTION

Figure 7:
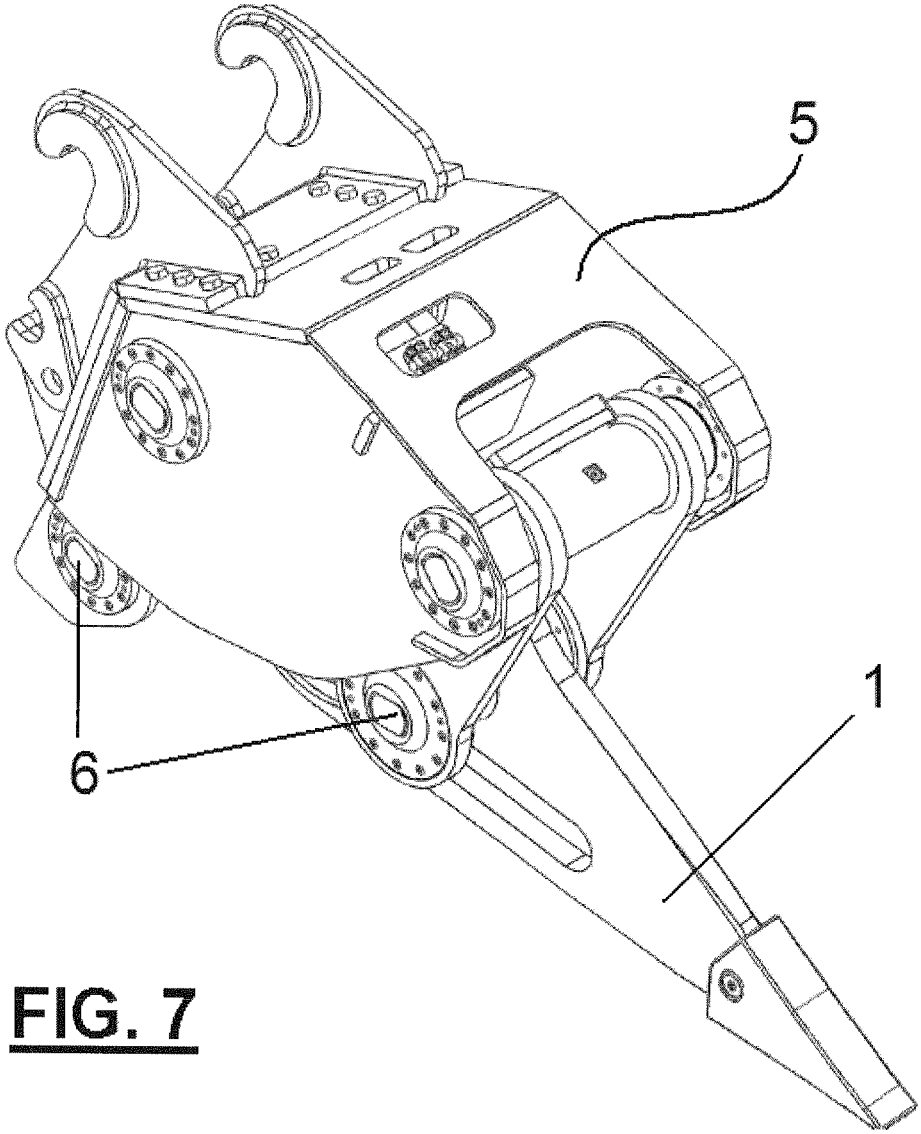
FIG. 7 is a perspective view of a practical embodiment of the hydraulic hammer ripper for mechanical diggers, in accordance with the present invention.

FIG. 7 is a perspective view of the ripper assembled with a hydraulic hammer and ready to be attached to the mechanical digger. The figure shows both the tooth (1) and the anchoring rods (6) and the connection to the headstock (5) on the mechanical digger.

Figure 8:
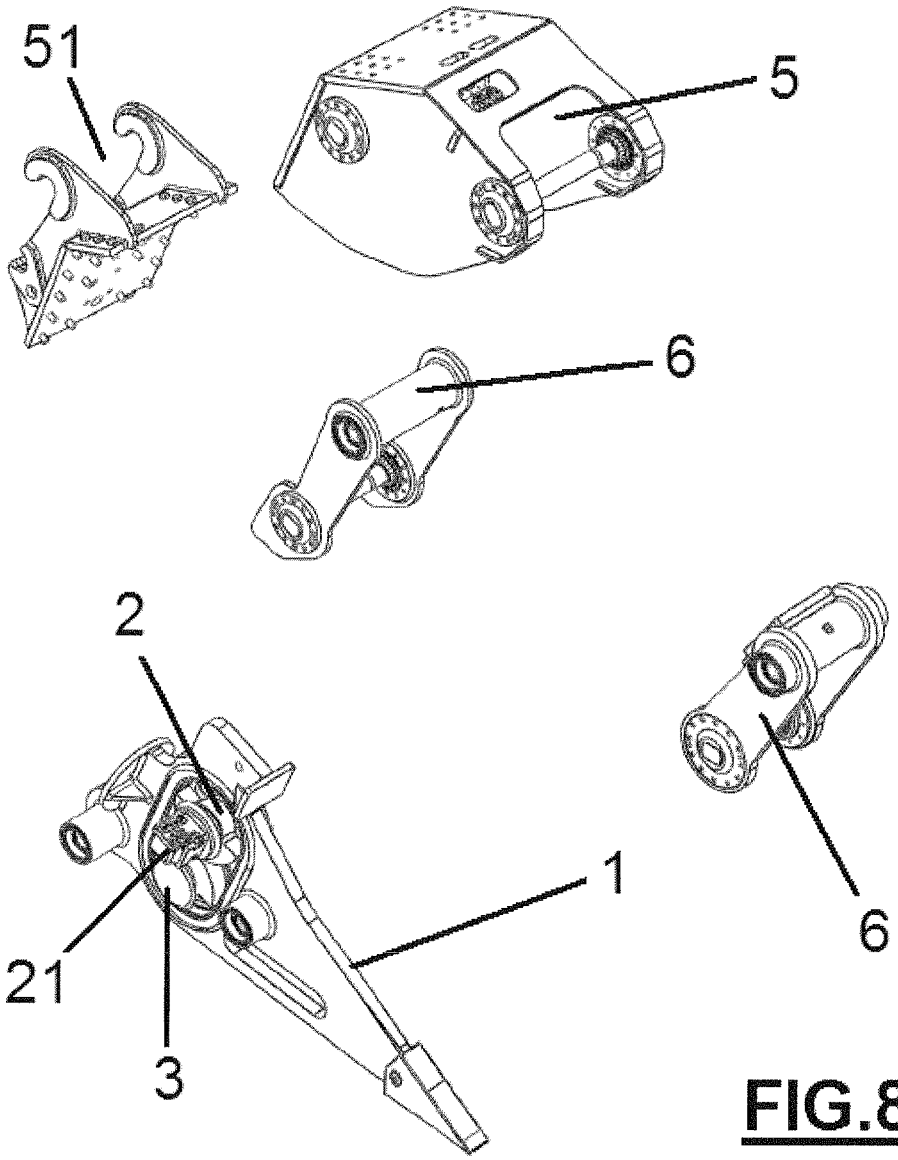
FIG. 8 is an exploded version of the view provided in FIG. 7
Figure 9:
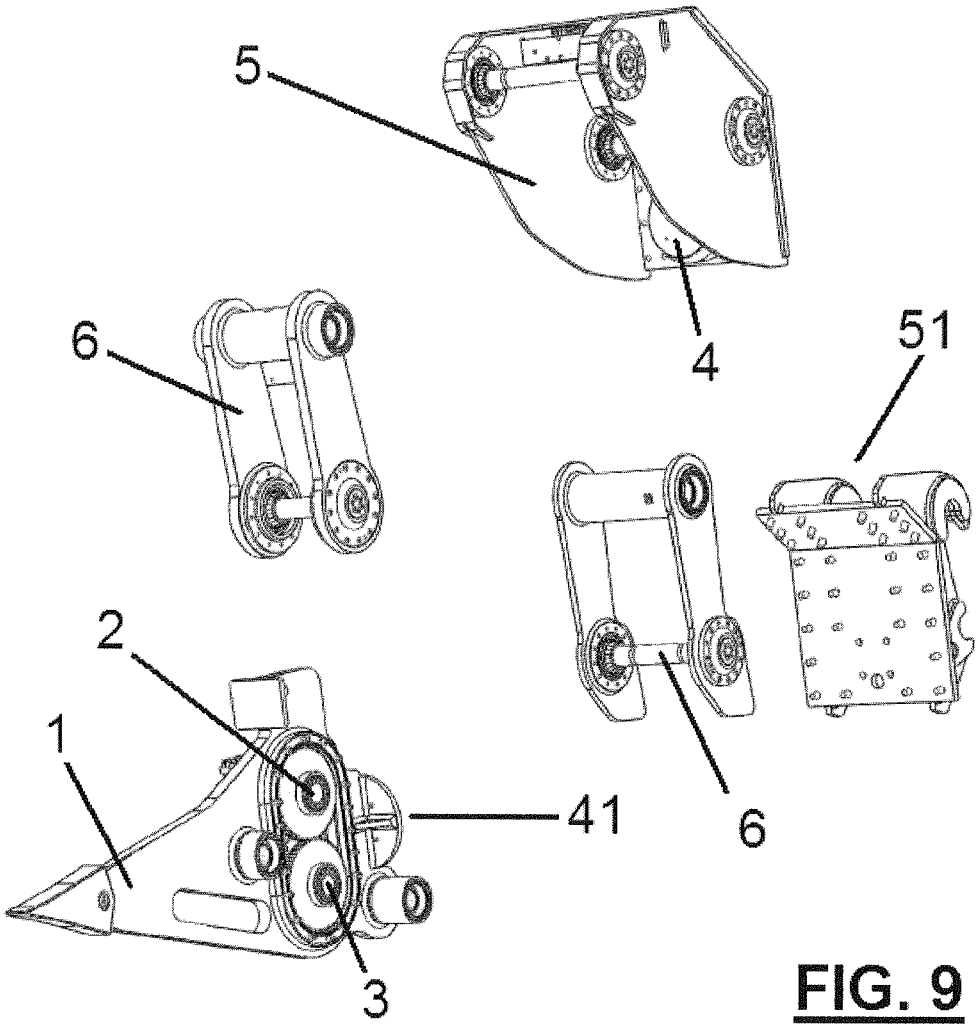
FIG. 9 is a lower perspective of the exploded view provided in FIG. 8 showing the various components in the hydraulic hammer ripper for mechanical diggers in accordance with the present invention.

FIG. 8, in an exploded view of FIG. 7, shows how the connection with the headstock (5) on the digger is made with the anchoring rods (6), a forward one and a rear one, whereas on the headstock itself, the headstock (5) is distinguished from the canopy (51) that provides support for the connection with the headstock. On it, and integrated with the tooth (1), one can see the drive devices (2, 3) basically comprising two cams engaged with each other, which is seen more clearly in FIG. 9, and driven by a motor (21), being also mounted on the axis of the tooth (1). The power accumulator (4) is connected to the headstock (5), and in this practical example there is an air-cushion that is solidly attached to both the headstock (5) and the mount (41) for the tooth (1).

The invention claimed is:

1. A hydraulic hammer ripper for mechanical diggers comprising a tooth with drive devices attached by means of attachment items to a headstock connected to a mechanical digger, wherein the drive devices are solidly attached to a power accumulator which is an air cushion or pneumatic cylinder;

wherein the tooth, the drive devices, and the power accumulator together form an assembly that is mounted on the longitudinal axis of the tooth that strikes the ground by means of the tooth moving between a withdrawn and a deployed position, wherein when the tooth is being raised said accumulator is charged whereas when the tooth is being dropped, said accumulator discharges in such a way that the energy stored in the power accumulator is released when the tooth drops towards the ground; and wherein the drive devices are connected to a hydraulic motor that receives pressure and oil flow from the mechanical digger, which ensures that the drive devices turn in opposite directions to each other, and generate a force vector axis when they rotate, wherein the drive devices consist of a first cam and a second cam that are symmetrically disposed with respect to the force vector axis of the tooth defined by the line that runs from the apex of the tip on the tooth and passes through rotation points on said tooth, and wherein the shaft of the first cam is engaged with a shaft of the second cam such that the tooth assumes a withdrawn and a deployed position along said force vector axis.

2. The hydraulic hammer ripper according to claim 1 wherein in a deployed position of the tooth the drive devices are situated in an angular position of −90°, pulling the tooth downwards, said angular position being defined within an x-y reference arrangement formed by the force vector axis of the tooth as a y-axis and an axis defined by the drive devices as an x-axis.

3. The hydraulic hammer ripper according to claim 1 wherein in a withdrawn position of the tooth the drive devices are situated in an angular position of 90°, pulling the tooth upwards and compressing the power accumulator, said angular position being defined within an x-y reference arrangement formed by the force vector axis of the tooth as a y-axis and an axis defined by the drive devices as an x-axis.

4. The hydraulic hammer ripper, according to claim 1 wherein the attachment items are not symmetrically arranged with each other, and variable in both length and position within the assembly.

5. The hydraulic hammer ripper according to claim 1, wherein a rigidness of the power accumulator is varied by varying a gas pressure, varying an internal volume of the power accumulator or varying both the gas pressure and the internal volume of the power accumulator, either manually or automatically.

6. The hydraulic hammer ripper according to claim 1 wherein a position of the power accumulator varies whereby power transmission between the tooth and the power accumulator becomes non-linear, producing a change in impact energy.

7. The hydraulic hammer ripper according to claim 6 wherein the power accumulator and the tooth interact by means of a system of levers.

8. A hydraulic hammer ripper for mechanical diggers comprising a tooth with drive devices attached by means of attachment items to a headstock connected to a mechanical digger, wherein the drive devices are solidly attached to a power accumulator which is an air cushion or pneumatic cylinder;

wherein the tooth, the drive devices, and the power accumulator together form an assembly that is mounted on the longitudinal axis of the tooth that strikes the ground by means of the tooth between a withdrawn and a deployed position, wherein when the tooth is being raised said accumulator is charged whereas when the tooth is being dropped, said accumulator discharges in such a way that the energy stored in the power accumulator is released when the tooth drops towards the ground, wherein the drive devices are connected to a hydraulic motor that receives pressure and oil flow from the mechanical digger, which ensures that the drive devices turn in opposite directions to each other, and generate a force vector axis when they rotate, and wherein the drive devices are arranged to describe an angle between the force vector axis and a guide axis generating an elliptical movement at the end of the tooth.

9. The hydraulic hammer ripper, according to claim 8 wherein the elliptical movement at the end of the tooth is achieved by a change in angle between the drive devices.

10. The hydraulic hammer ripper, according to claim 8, wherein the ellipse described by the end of the tooth is achieved by changing the center of gravity between the drive devices with said drive devices not being symmetrically arranged with each other.

11. The hydraulic hammer ripper according to claim 8 wherein the ellipse described by the end of the tooth is achieved by changing the center of gravity between the drive devices with said drive devices not being symmetrically arranged with each other.

12. The hydraulic hammer ripper according to claim 8 wherein the attachment items are not symmetrically arranged with each other, and variable in both length and position within the assembly.

13. The hydraulic hammer ripper according to claim 8 wherein the power accumulator varies its rigidness, either manually or automatically, according to the following:

a) modifying a gas pressure in the power accumulator; or b) modifying an internal volume of the power accumulator; or c) modifying both the gas pressure and the internal volume of the power accumulator.

14. Hydraulic hammer ripper according to claim 8 wherein the position of the power accumulator varies whereby the power transmission between the tooth and the power accumulator becomes non-linear, producing a change in an impact energy.

15. Hydraulic hammer ripper according to claim 14 wherein the power accumulator and the tooth interact by means of a system of levers.

* * * * *